US008959735B2

(12) United States Patent
Kudo et al.

(10) Patent No.: US 8,959,735 B2
(45) Date of Patent: Feb. 24, 2015

(54) MANUFACTURING METHOD OF LIQUID EJECTION HEAD, LIQUID EJECTION HEAD, AND INKJET PRINTING APPARATUS

(71) Applicant: Canon Kabushiki Kaisha, Tokyo (JP)

(72) Inventors: Kiyomitsu Kudo, Machida (JP); Yuichiro Akama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/904,239

(22) Filed: May 29, 2013

(65) Prior Publication Data

US 2013/0321529 A1 Dec. 5, 2013

(30) Foreign Application Priority Data

Jun. 5, 2012 (JP) ..... 2012-127921

(51) Int. Cl.
*B21D 53/76* (2006.01)
*B41J 2/16* (2006.01)
*B41J 2/14* (2006.01)

(52) U.S. Cl.
CPC ..... *B41J 2/1637* (2013.01); *B41J 2/1433* (2013.01); *B41J 2/1603* (2013.01); *B41J 2/1628* (2013.01); *B41J 2/1629* (2013.01); *B41J 2/1632* (2013.01); *B41J 2/1634* (2013.01); *B41J 2/1635* (2013.01); *B41J 2/1639* (2013.01); *B41J 2/1645* (2013.01)
USPC ..... 29/25.35

(58) Field of Classification Search
None
See application file for complete search history.

(56) References Cited

U.S. PATENT DOCUMENTS

| | | | | |
|---|---|---|---|---|
| 6,540,335 | B2 | 4/2003 | Touge et al. | |
| 8,100,505 | B2 | 1/2012 | Kuroda et al. | |
| 8,397,358 | B2 * | 3/2013 | Li | 29/25.35 |
| 8,621,751 | B2 * | 1/2014 | Cheng et al. | 29/890.1 |
| 8,641,173 | B2 * | 2/2014 | Naono et al. | 347/68 |

FOREIGN PATENT DOCUMENTS

JP 4018272 B2 12/2007

* cited by examiner

*Primary Examiner* — Lamson Nguyen
(74) *Attorney, Agent, or Firm* — Fitzpatrick, Cella, Harper & Scinto

(57) ABSTRACT

In the case where a slit is provided in a projection portion of an outlet plate, patterning property of a slit can be improved, and a desired slit can be formed. The present invention is a manufacturing method of a liquid ejection head including a substrate; an ejection outlet plate; a channel; and the supply ports formed between the substrate and the ejection outlet plate by joining of the ejection outlet plate onto the substrate; and a projection portion having a slit at a position facing the supply port of the ejection outlet plate, the method including the steps of: forming a first member on the substrate; forming a mold material for forming the slit between first member on the substrate; forming a second member serving as the ejection outlet plate on the mold material; forming the projection portion by removing the mold material.

6 Claims, 26 Drawing Sheets

MANUFACTURING METHOD OF LIQUID EJECTION HEAD, LIQUID EJECTION HEAD, AND INKJET PRINTING APPARATUS

BACKGROUND OF THE INVENTION

1. Field of the Invention

The present invention relates to a manufacturing method of a liquid ejection head, a liquid ejection head, and an inkjet printing apparatus, and more particularly to a manufacturing method of a liquid ejection head in which a slit is provided in a projection portion, a liquid ejection head, and an inkjet printing apparatus.

2. Description of the Related Art

Regarding a liquid ejection head for ejecting liquid at a high speed by giving an electric signal to a thermoelectric conversion element to thereby instantaneously boil liquid, integration of channels is easy but residual air bubbles might occur in a liquid ejection head. The residual air bubbles occur since air dissolved in the ink by heat generated by the thermoelectric conversion element is eluted and bubbles of the air remain in the liquid ejection head. In the case where the residual air bubbles are left as they are, that gives a bad effect to eject characteristics of the liquid and might cause deterioration in images.

Therefore, in order to suppress such residual air bubbles, there is known a technology of providing a projection portion on an inner surface of an ejecting outlet plate of the liquid ejection head (See the specification of Japanese Patent No. 4018272, for example). By providing the projection portion on the inner surface of the ejection outlet plate, a speed component can be given to a flow of ink in parallel with the ejection outlet plate, and the bad effect exerted on the ejecting of the residual air bubbles can be eased.

Furthermore, there can also be considered a technology in which residual stress in an ejection outlet plate of the liquid ejection head is eased by providing a slit in the projection portion. By providing a slit, the residual stress in the liquid ejection head caused by a heat history or the like of a manufacturing process of the liquid ejection head can be eased, and nozzle peeling caused by the residual stress in the ejection outlet plate can be suppressed. Particularly, in the liquid ejection head having a plurality of nozzle rows, there is a great concern that the residual stress in the ejection outlet plate is large in the central part of the outermost row and the nozzle is separated. By providing a slit in the projection portion, the residual stress can be eased, and occurrence of ejection outlet plate and substrate peeling can be suppressed. Furthermore, depending on ink in use, the ejection outlet plate might be swollen, but by providing a slit in the projection portion, stress caused by the swollen ejection outlet plate can be eased.

Incidentally, the slit provided in the projection portion is formed by patterning a mold material on a portion serving as a slit on a surface where a supply port penetrates, by coating an ejection outlet plate serving as an ejection outlet plate thereon, by exposing and developing it, then by penetrating the supply port, and by removing the mold material.

However, in a method of forming a slit in the projection portion, defective patterning might occur due to an insufficient adhesion force between the surface where the supply port is penetrated and the mold material serving as the slit, and thus a desired slit cannot be formed. The surface where the supply port is penetrated and its vicinity is a smooth surface because there is no thermoelectric conversion element or wiring pattern for sending an electric signal to the thermoelectric conversion signal, and thus there is no anchoring effect or the like and the adhesion force might be insufficient.

Furthermore, a substrate having a plurality of thermoelectric conversion elements is formed through a semiconductor process, but since the size of a semiconductor wafer is increasing, an external force generated during development of the mold material becomes large. Moreover, along with the increasing length of the liquid ejection head, the length of the slit in the projection portion also increases, and the external force generated on an end portion of the mold material becomes further larger. As described above, due to the increase of the size of the semiconductor wafer and the length of the liquid ejection head, the external force generated during development of the mold material becomes further larger and there is a concern that defective patterning in development of the mold material might increase.

SUMMARY OF THE INVENTION

The present invention has been made in view of the above problems and has an object to provide a manufacturing method of a liquid ejection head in which patterning property of a slit is improved and a desired slit can be formed in the case where a slit is provided in a projection portion of an ejection outlet plate, a liquid ejection head, and an inkjet printing apparatus.

In order to achieve the object, the present invention is a manufacturing method of a liquid ejection head including a substrate on which a plurality of elements each generating energy for ejecting liquid is aligned and which has a supply port extending in an alignment direction of the plurality of elements; an ejection outlet plate provided with a plurality of ink ejection outlets each ejecting liquid; a channel communicating with the plurality of ejection outlets and the supply ports formed between the substrate; and the ejection outlet plate by joining of the ejection outlet plate onto the substrate; and a projection portion having a slit at a position facing the supply port of the ejection outlet plate, the method comprising the steps of: forming a first member on the substrate; forming a mold material for forming the slit between first member on the substrate; forming a second member serving as the ejection outlet plate on the mold material; forming the projection portion by removing the mold material.

According to the above configuration, by providing the inner layer at the position in contact with a pattern for forming a slit, a desired slit can be formed in the projection portion of the ejection outlet plate. As a result, the residual stress in the ejection outlet plate caused by a heat history or the like of the manufacturing process of the liquid ejection head can be eased, and occurrence of nozzle peeling can be suppressed.

Further features of the present invention will become apparent from the following description of exemplary embodiments (with reference to the attached drawings).

DESCRIPTION OF THE EMBODIMENTS

Hereinafter, embodiments of the present invention will be described in detail by referring to the attached drawings.

First Embodiment

Figure 1A:
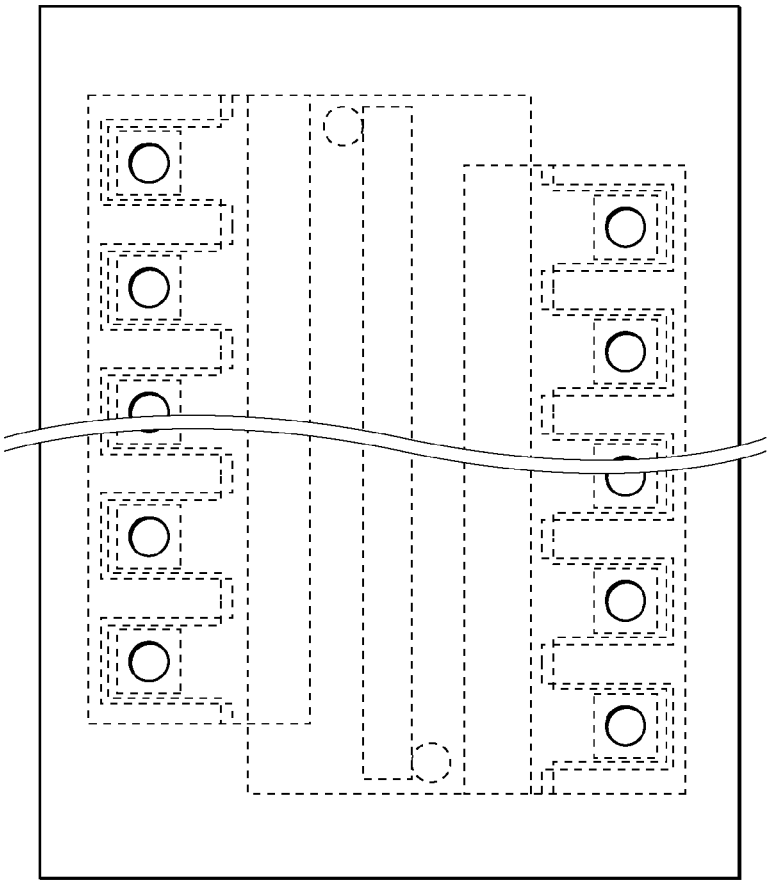
FIGS. 1A and 1B are outline diagrams illustrating a liquid ejection head of a first embodiment.
Figure 1B:
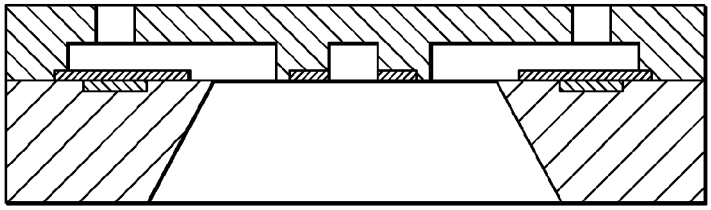

FIGS. 1A and 1B are outline diagrams illustrating a liquid ejection head for ejecting liquid such as ink of the present embodiment. In the present embodiment, a manufacturing method of the liquid ejection head illustrated in FIGS. 1A and 1B will be described.

Figure 2:
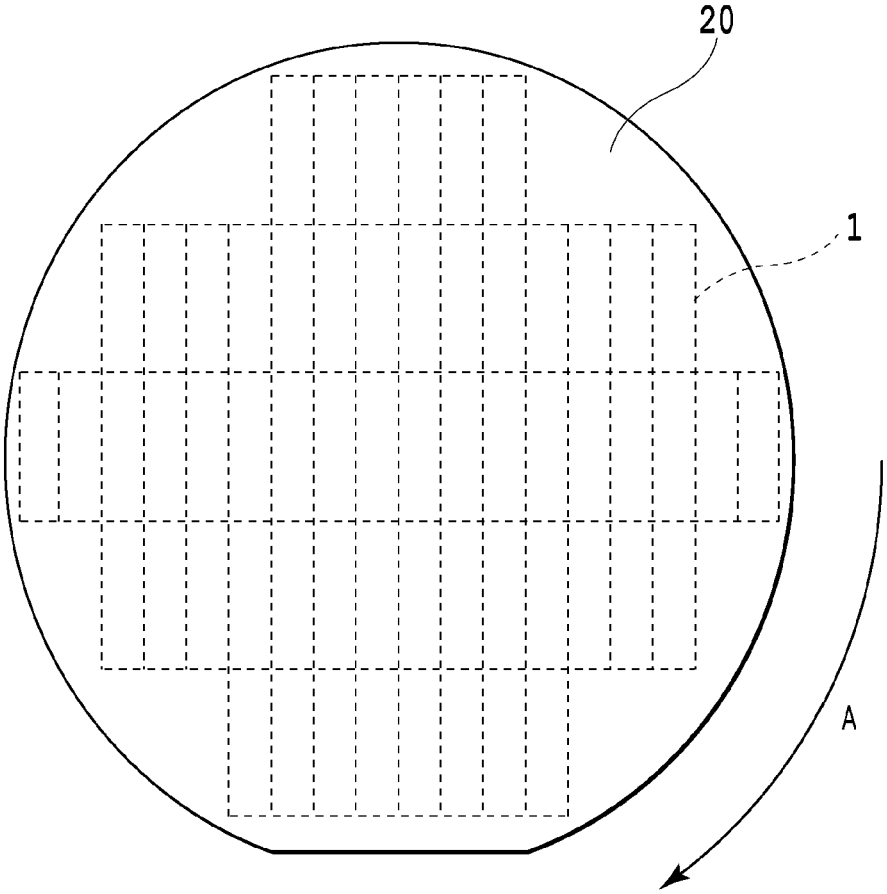
FIG. 2 is a plan view conceptually illustrating a 6-inch Si wafer of the first embodiment.

FIG. 2 is a plan view conceptually illustrating a 6-inch Si wafer of the present embodiment. First, a 6-inch Si wafer is prepared as a substrate wafer 20.

On the 6-inch Si wafer of the present embodiment, a plurality of substrates 1 is arranged. A single substrate fluidizes in a state of the 6-inch Si wafer until formation of a nozzle is completed, and by cutting the wafer after the formation of the nozzle is completed, each individual substrate is provided.

FIGS. 3A and 3B to FIGS. 8A and 8B are conceptual diagrams for explaining a nozzle-forming process of the present embodiment. Each FIG. A is a plan view illustrating the substrate of the present embodiment, while each FIG. B is a cross-sectional view illustrating the substrate of the present embodiment. For ease of understanding of the explanation, a process of a single substrate will be explained.

Figure 3A:
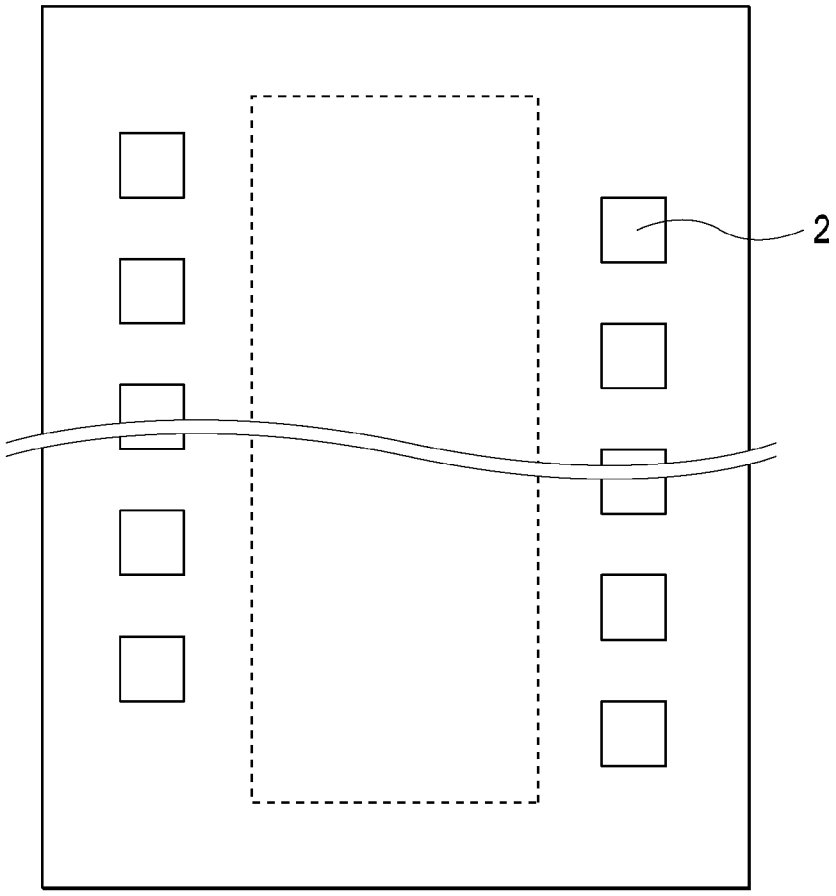
FIGS. 3A and 3B are conceptual diagrams for explaining a nozzle-forming process of the first embodiment.
Figure 3B:
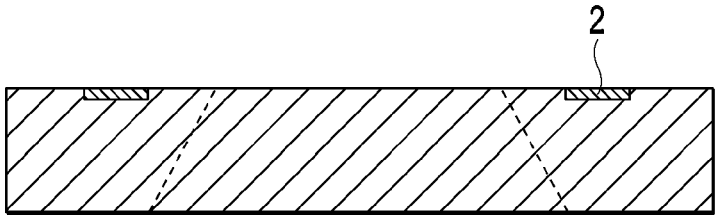

First, as illustrated in FIGS. 3A and 3B, a desired number of thermoelectric conversion elements 2 generating energy for ejecting liquid are aligned on the substrate.

Figure 4A:
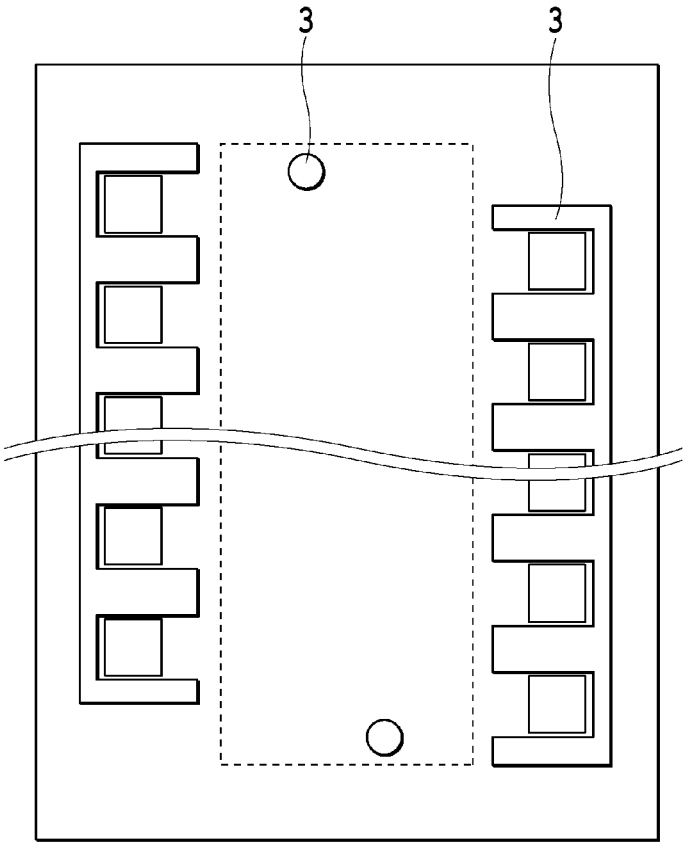
FIGS. 4A and 4B are conceptual diagrams for explaining the nozzle-forming process of the first embodiment.
Figure 4B:
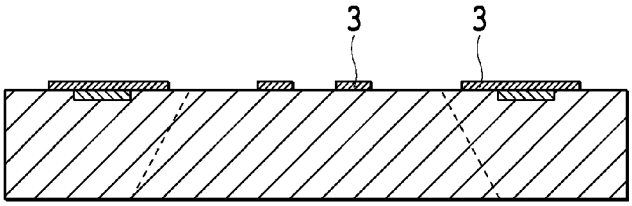

Next, as illustrated in FIGS. 4A and 4B, an inner layer (first member) 3 are patterned. As the inner layer, a polyetheramide resin (HIMAL1200 by Hitachi Chemical Co., Ltd.) is used, and patterning is carried out on a portion where an ejection outlet plate is to be formed and a part of an opening surface of a supply port extending in the alignment direction of the thermoelectric conversion elements.

Figure 5A:
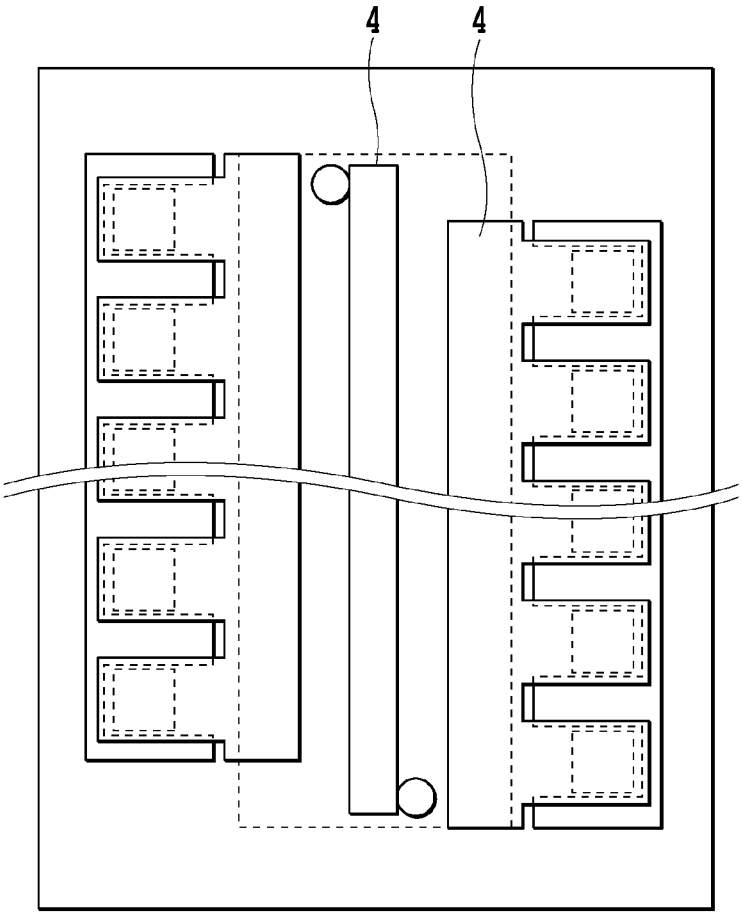
FIGS. 5A and 5B are conceptual diagrams for explaining the nozzle-forming process of the first embodiment.
Figure 5B:
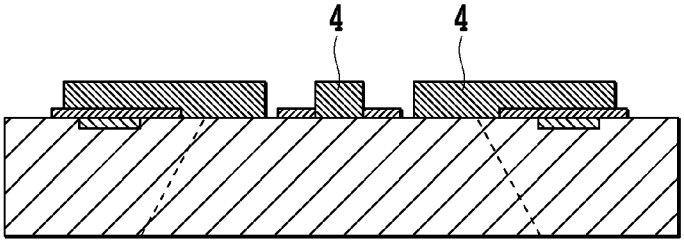

Subsequently, as illustrated in FIGS. 5A and 5B, a mold material 4 is patterned. The mold material forms a pattern of a channel that allows an ejection outlet and the supply port to communicate with each other and also forms an independent pattern for forming a slit (mold material) on the opening surface of the supply port. The mold material is formed by, after coating the mold material on the substrate, exposing it to UV light or the like, and by developing it with a spin coater.

Figure 6A:
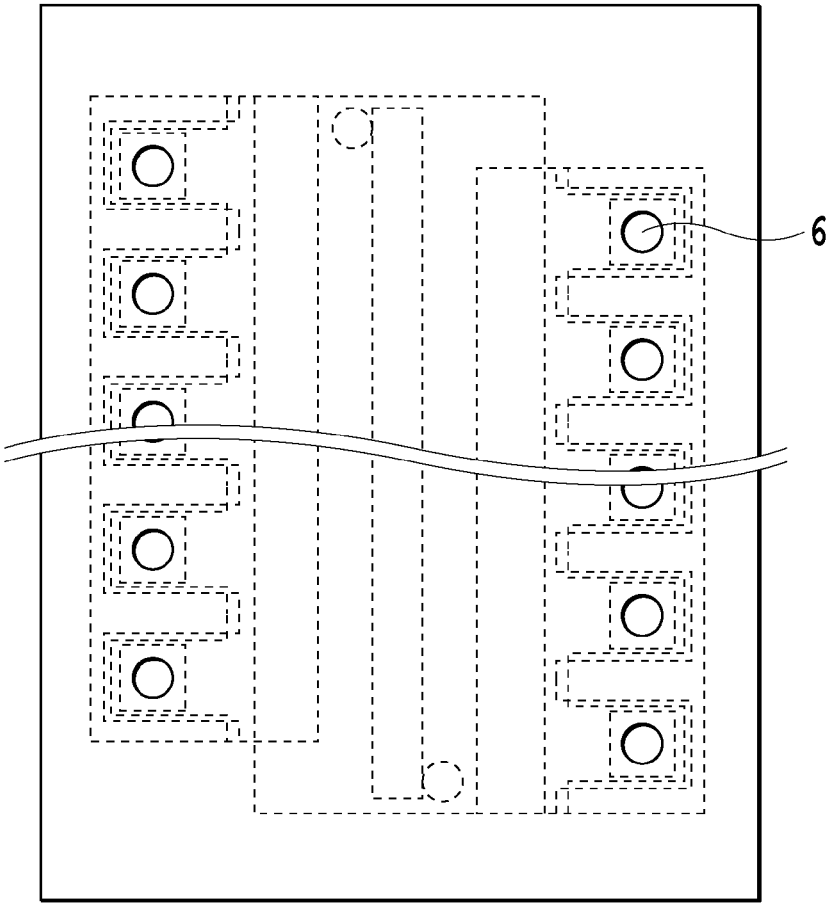
FIGS. 6A and 6B are conceptual diagrams for explaining the nozzle-forming process of the first embodiment.
Figure 6B:
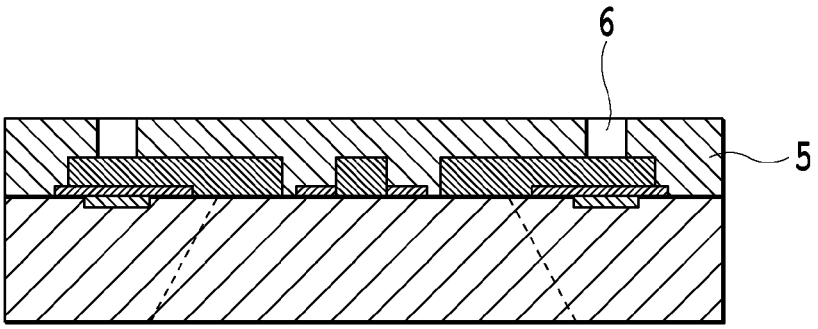

Subsequently, as illustrated in FIGS. 6A and 6B, a second member contain photosensitive resin is arranged as covering the mold material and the ejection outlet 6 is formed by pattering. Then, ejection outlet plate 5 is formed. Also, the ink ejection outlet may be formed by every method such as etching by $O_2$ plasma, excimer laser drilling, or exposure with ultraviolet light, Deep-UV light and the like.

Figure 7A:
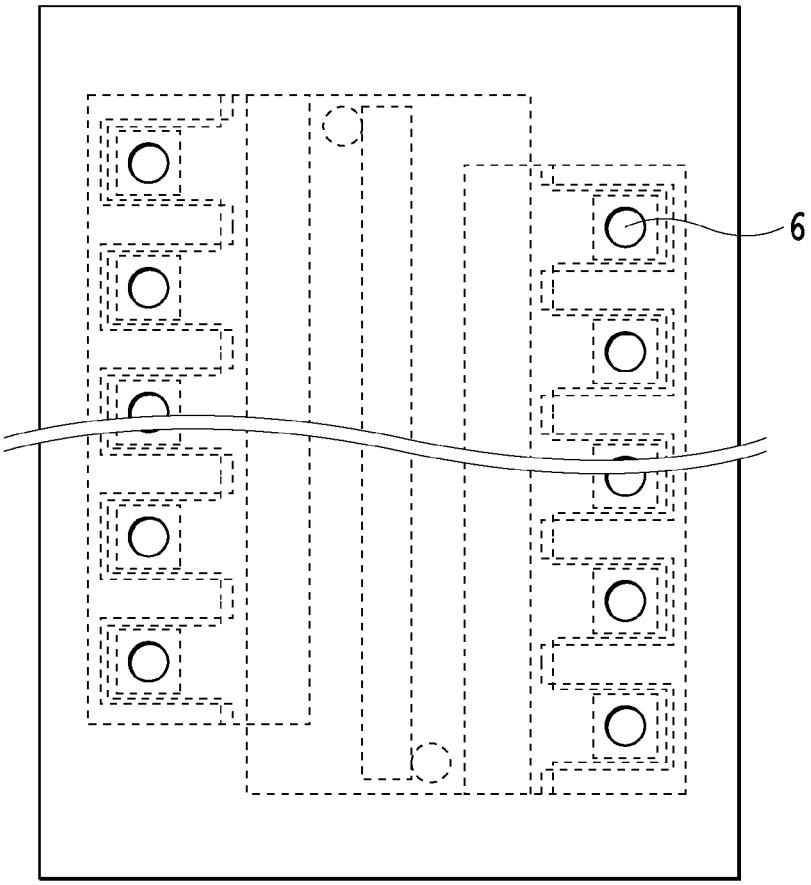
FIGS. 7A and 7B are conceptual diagrams for explaining the nozzle-forming process of the first embodiment.
Figure 7B:
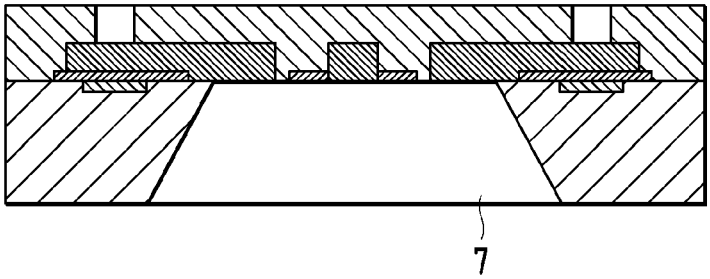

Subsequently, as illustrated in FIGS. 7A and 7B, the supply port 7 is provided on the substrate. The supply port is formed by chemically etching the substrate. Specifically, a Si (silicon) substrate is used as the substrate, and the supply port is formed by anisotropic etching with a strong alkaline solution such as KOH, NaOH, TMAH and the like.

Figure 8A:
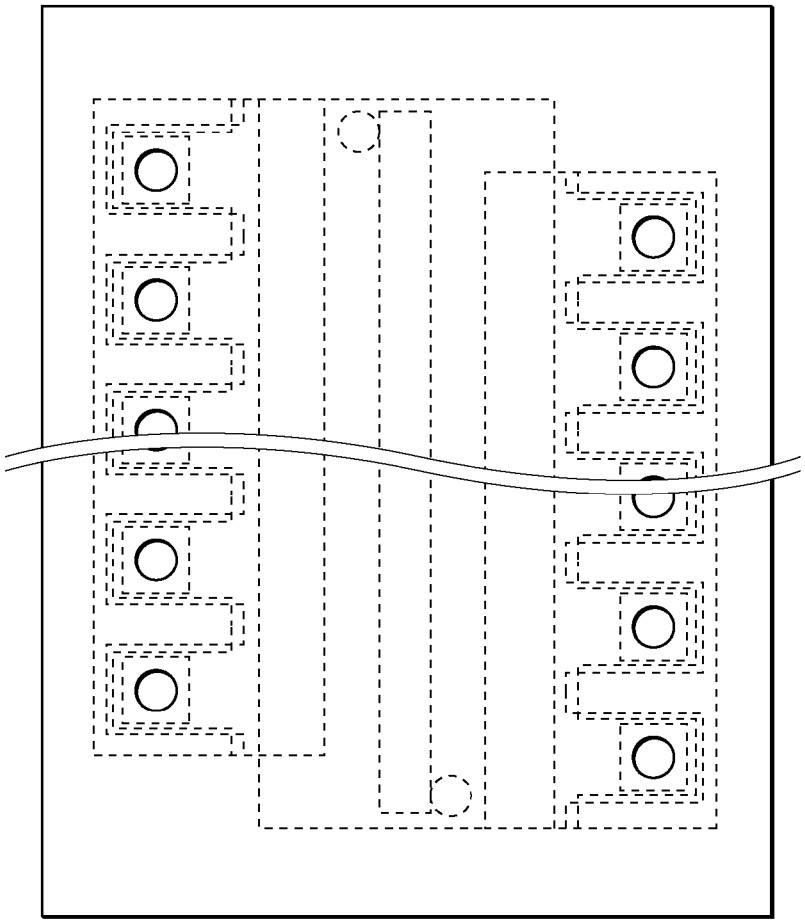
FIGS. 8A and 8B are conceptual diagrams for explaining the nozzle-forming process of the first embodiment.
Figure 8B:
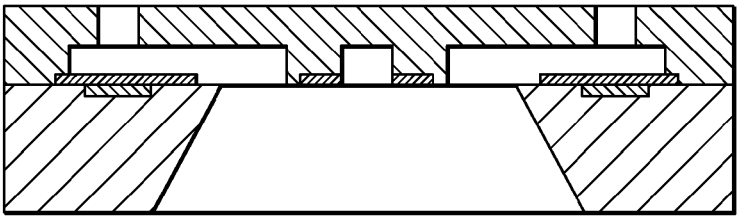

Subsequently, as illustrated in FIGS. 8A and 8B, the mold material is removed. By removing the mold material, the channel and a projection portion having a slit in the ejection outlet plate are formed.

The patterning of the mold material is performed by developing a developing solution through the use of a spin coater, and the spin coater rotates in a direction of an arrow A illustrated in FIG. 2.

In the present embodiment, as illustrated in FIGS. 5A and 5B, the circular-shaped inner layer is arranged at a position in contact with both ends of the pattern for forming a slit. In the case where the mold material is developed by the spin coater, the circular-shaped inner layer is arranged in a direction where pattern shifting can easily occur in the mold material due to an external force, and thus the occurrence of pattern shifting can be suppressed. Since the pattern for forming a slit is formed on the opening surface of the supply port, there are no irregularities on a foundation and an adhesion force is lower than that of the pattern in the vicinity of the thermoelectric conversion element, and there is a great concern of positional shifting of the mold material. Particularly, in the case of fluidization with the 6-inch Si wafer, a centrifugal force by the spin coater at the time of development is large, and without the inner layer, pattern shifting might occur. Furthermore, with progress of elongation of the nozzle row, the pattern for forming a slit becomes longer, and the external force applied to the pattern for forming a slit becomes further larger.

Figure 9C:
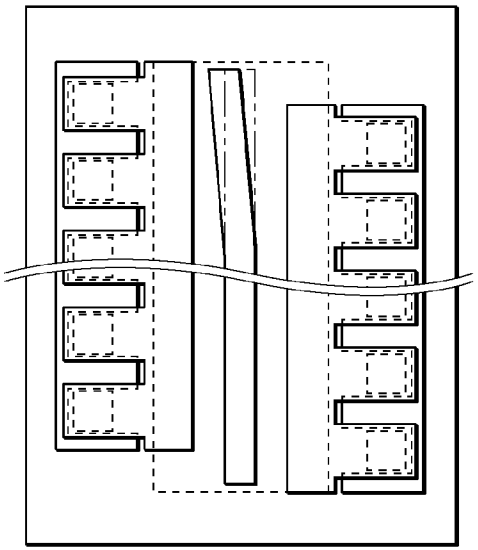
FIGS. 9A to 9C are outline diagrams illustrating a liquid ejection head of a prior-art embodiment.
Figure 9B:
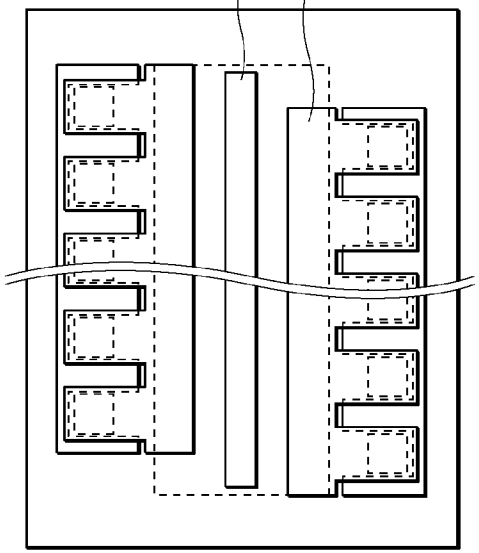
Figure 9A:
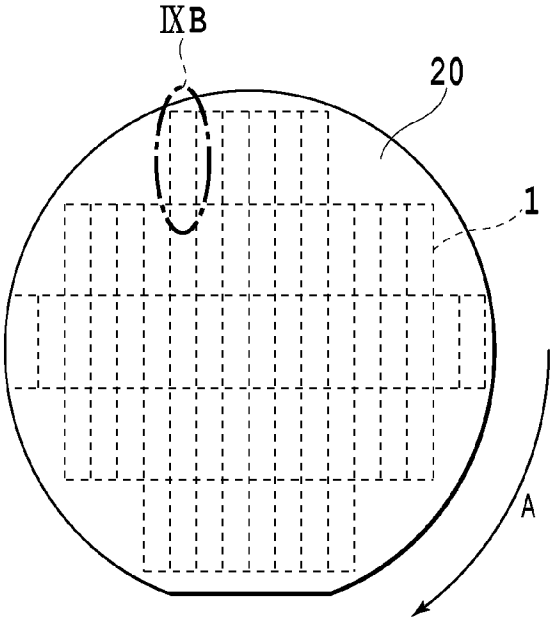

FIGS. 9A to 9C are outline diagrams illustrating a liquid ejection head of a prior-art embodiment.

FIG. 9A illustrates a substrate wafer 20. Furthermore, FIG. 9B is an enlarged diagram of a IXB portion illustrated in FIG. 9A. As illustrated in FIG. 9B, the liquid ejection head of the prior-art embodiment has no inner layer provided at the position in contact with the pattern for forming a slit. Therefore, in the case where the mold material is developed by the spin coater, pattern shifting might occur in the mold material due to the external force (centrifugal force) as illustrated in FIG. 9C. Particularly, the external force (centrifugal force) is larger in the pattern close to an outer periphery of the wafer, and pattern shifting easily occurs.

As described above, also at the time of increase in the size of the semiconductor wafer or the increase in the length of the liquid ejection head, by providing the inner layer at the position in contact with the pattern for forming a slit, a desired slit can be formed in the projection portion of the ejection outlet plate.

As a result, residual stress in the ejection outlet plate caused by a heat history or the like of a manufacturing process of the liquid ejection head can be eased, the occurrence of nozzle peeling can be suppressed, and a reliable liquid ejection head can be provided.

Second Embodiment

In the first embodiment, the circular-shaped adhesion improvement layer is arranged at the position in contact with the both ends of the pattern for forming a slit. However, the present invention is not limited to the inner layer having such a shape.

Figure 10A:
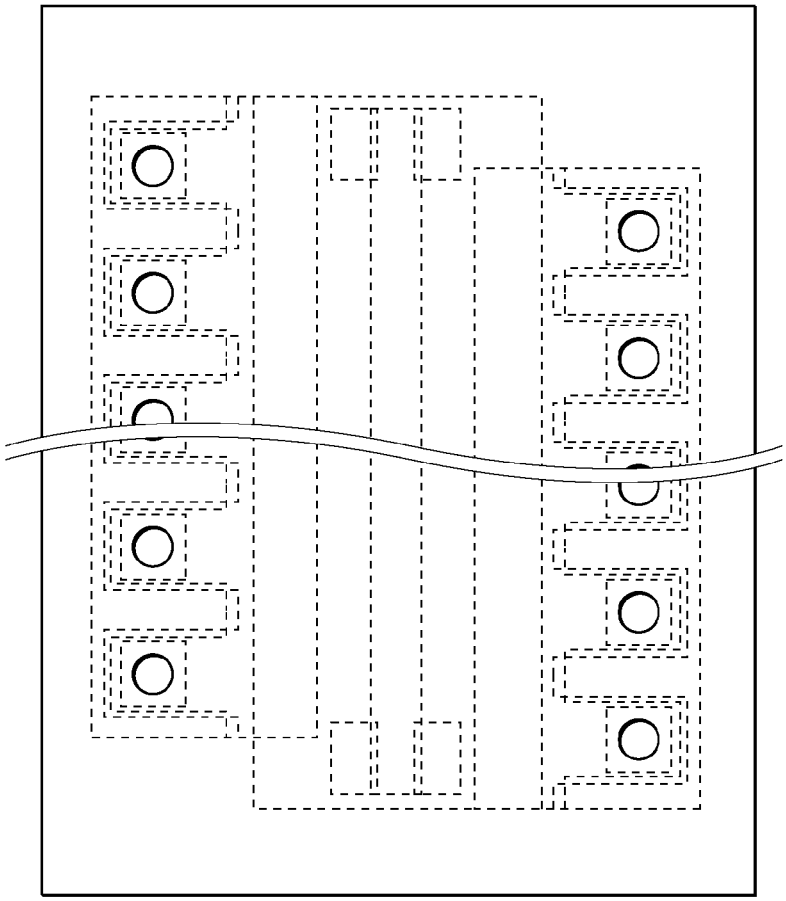
FIGS. 10A and 10B are conceptual diagrams illustrating a liquid ejection head of a second embodiment.
Figure 10B:
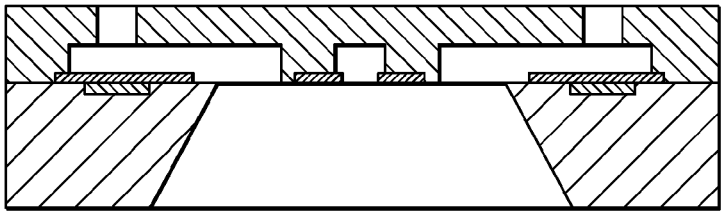

FIGS. 10A and 10B are outline diagrams illustrating a liquid ejection head of the present embodiment. In the present embodiment, a manufacturing method of the liquid ejection head illustrated in FIGS. 10A and 10B will be described.

FIGS. 11A and 11B to FIGS. 16A and 16B are conceptual diagrams for explaining a nozzle-forming process of the present embodiment. Each FIG. A is a plan view illustrating the substrate of the present embodiment, while each FIG. B is a cross-sectional view illustrating the substrate of the present embodiment. For ease of understanding of the explanation, a process of a single substrate will be explained.

Figure 11A:
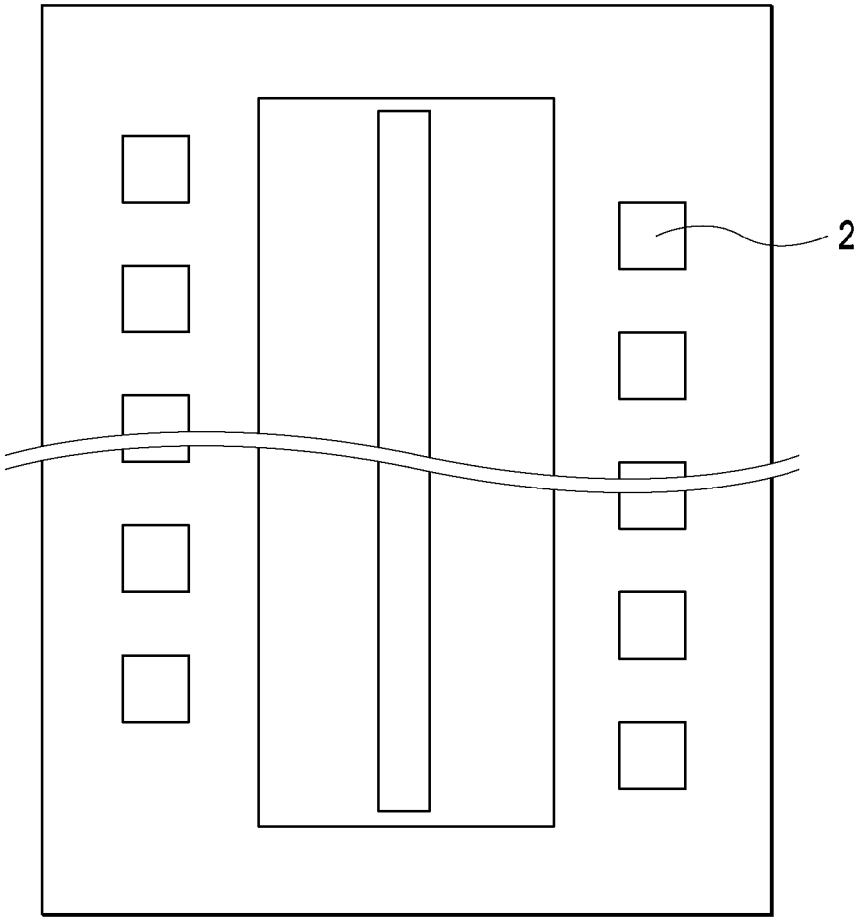
FIGS. 11A and 11B are outline diagrams for explaining the nozzle-forming process of the second embodiment.
Figure 11B:
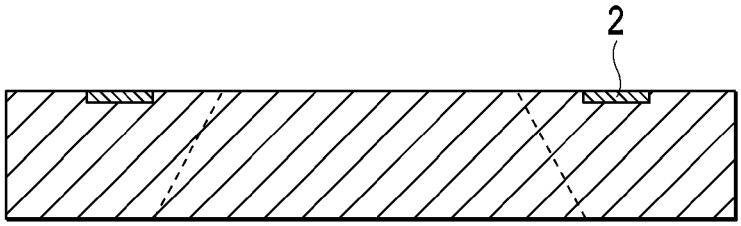

As illustrated in FIGS. 11A and 11B, a desired number of the thermoelectric conversion elements 2 are arranged on the substrate.

Figure 12A:
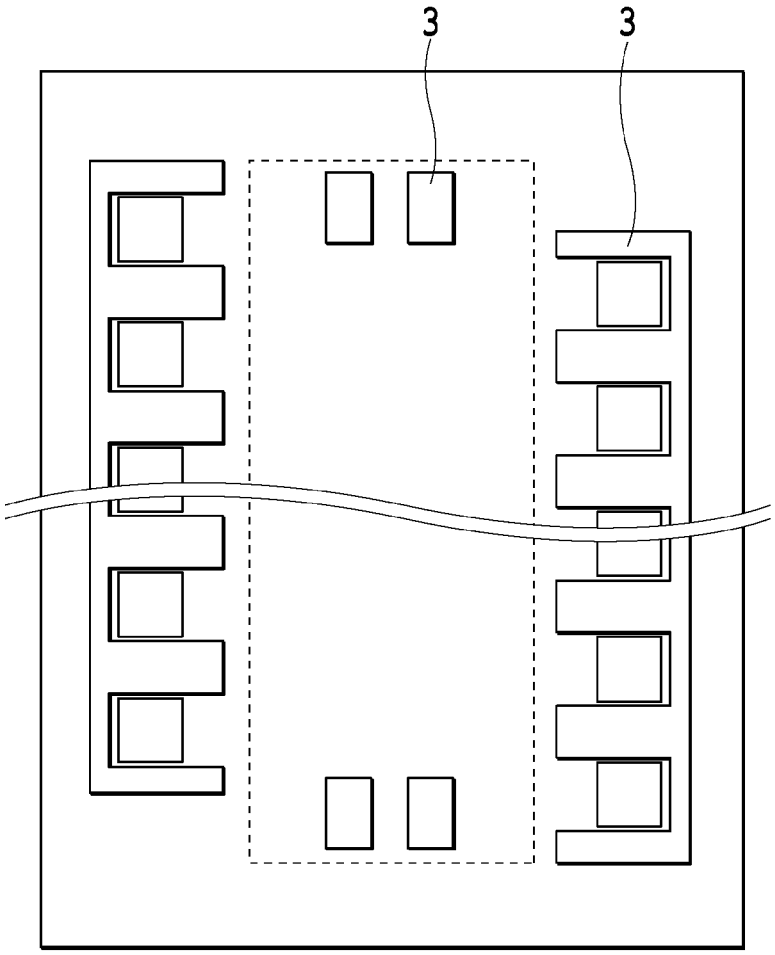
FIGS. 12A and 12B are outline diagrams for explaining the nozzle-forming process of the second embodiment.
Figure 12B:
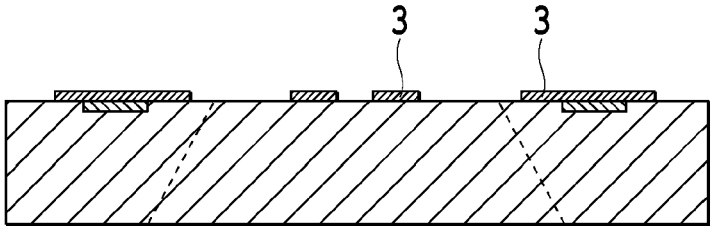

Next, as illustrated in FIGS. 12A and 12B, the inner layer 3 is patterned. The inner layer is patterned on a portion where the ejection outlet plate is formed and a part of the opening surface of the supply port.

Figure 13A:
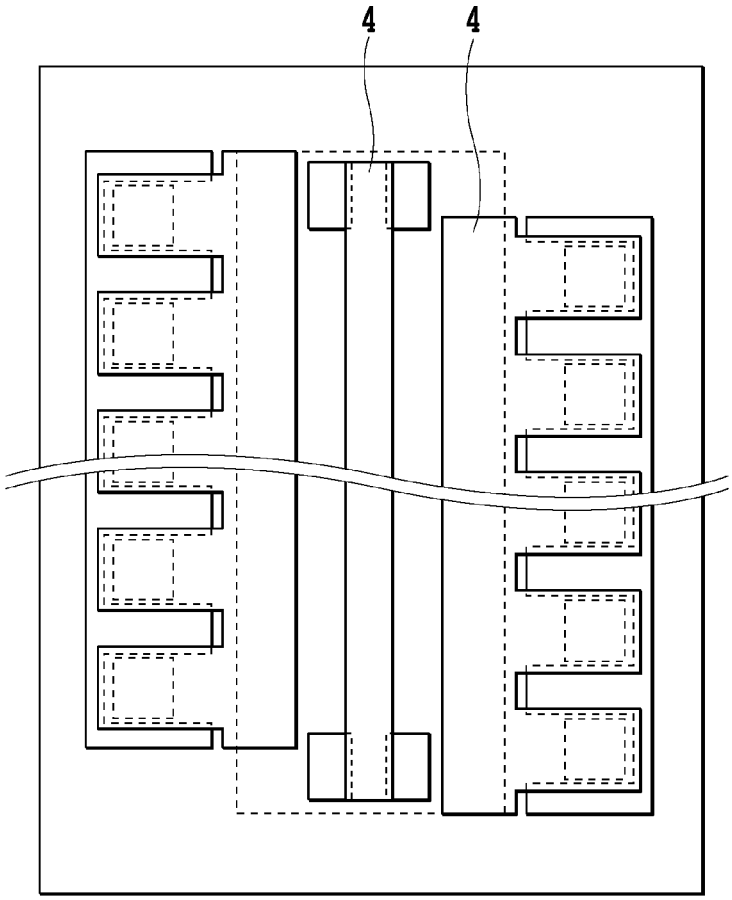
FIGS. 13A and 13B are outline diagrams for explaining the nozzle-forming process of the second embodiment.
Figure 13B:
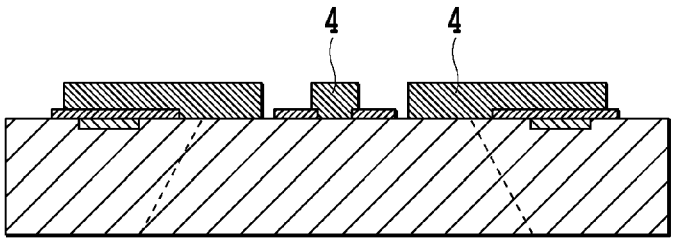

Subsequently, as illustrated in FIGS. 13A and 13B, the mold material 4 is patterned. The mold material forms a pattern of the channel and also forms an independent pattern for forming a slit on the opening surface of the supply port. The mold material is formed by, after coating the mold material on the substrate, exposing it to UV light or the like, and developing it with a spin coater.

Figure 14A:
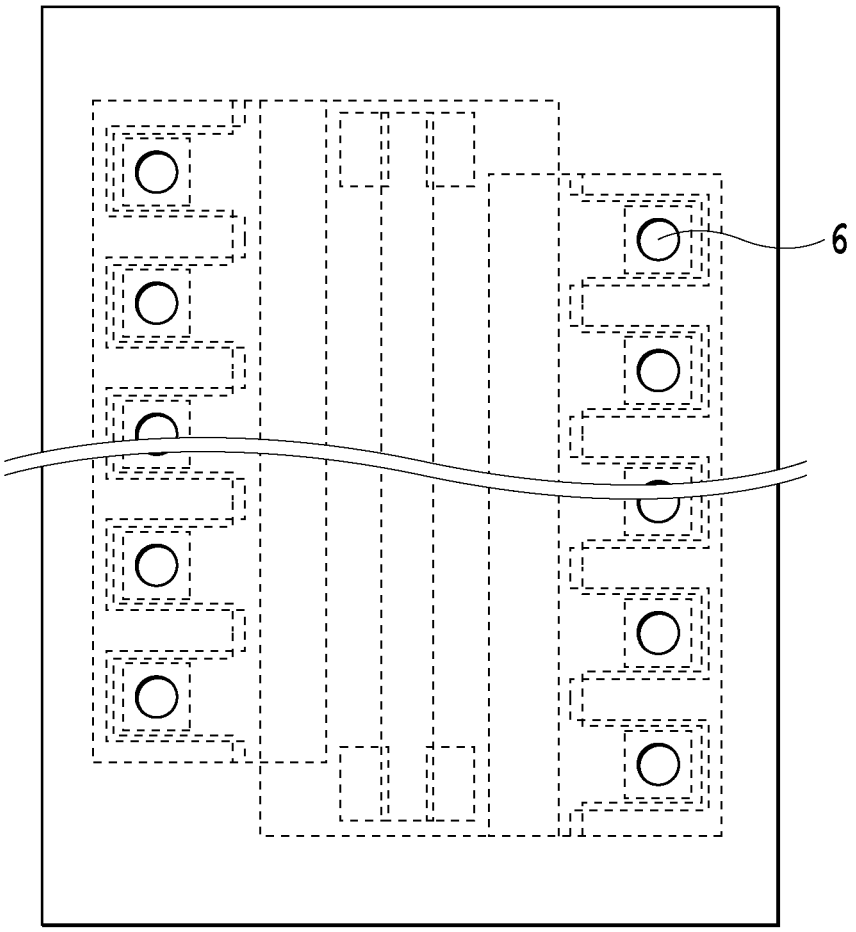
FIGS. 14A and 14B are outline diagrams for explaining the nozzle-forming process of the second embodiment.
Figure 14B:
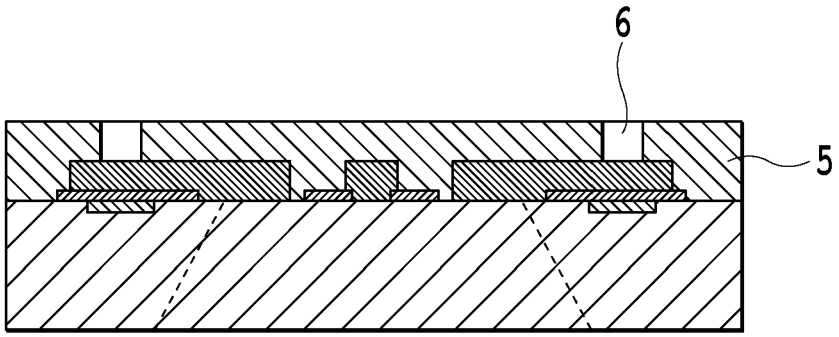

Then, as illustrated in FIGS. 14A and 14B, the ejection outlet plate 5 is patterned. The ejection outlet plate is arranged so as to cover the mold material and forms the ejection outlet 6.

Figure 15A:
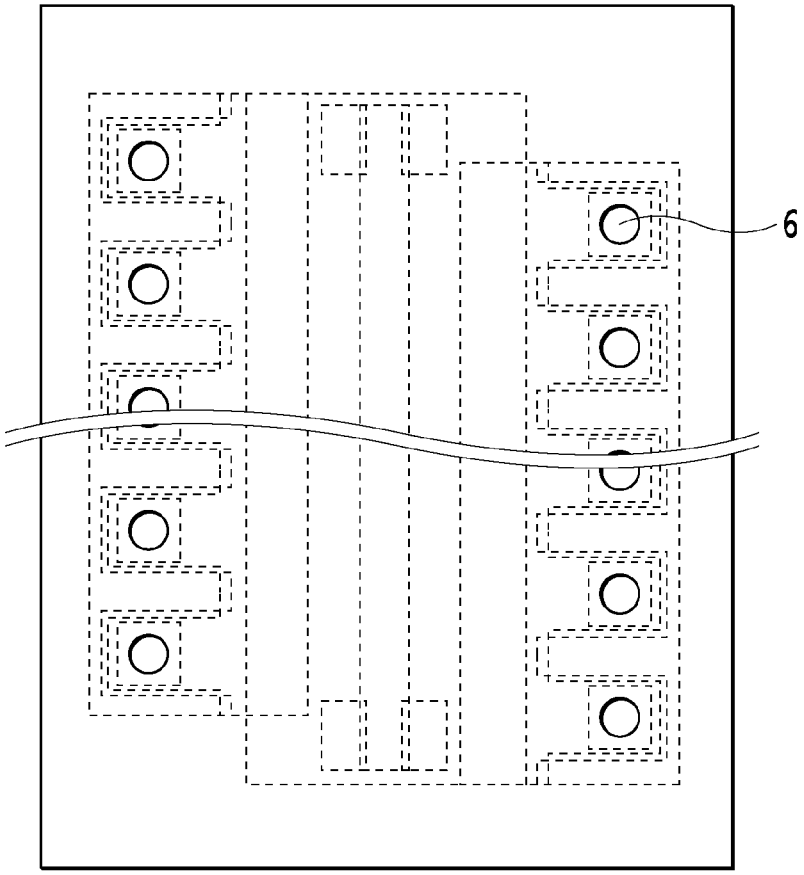
FIGS. 15A and 15B are outline diagrams for explaining the nozzle-forming process of the second embodiment.
Figure 15B:
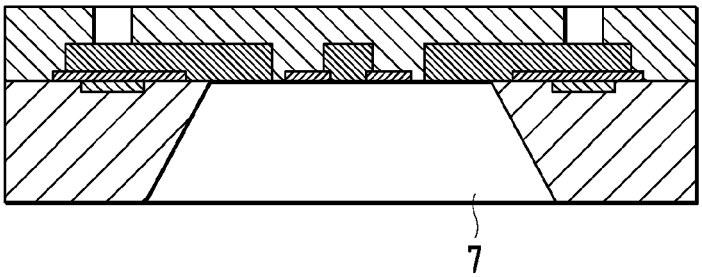

Next, as illustrated in FIGS. 15A and 15B, the supply port 7 is provided on the substrate.

Figure 16A:
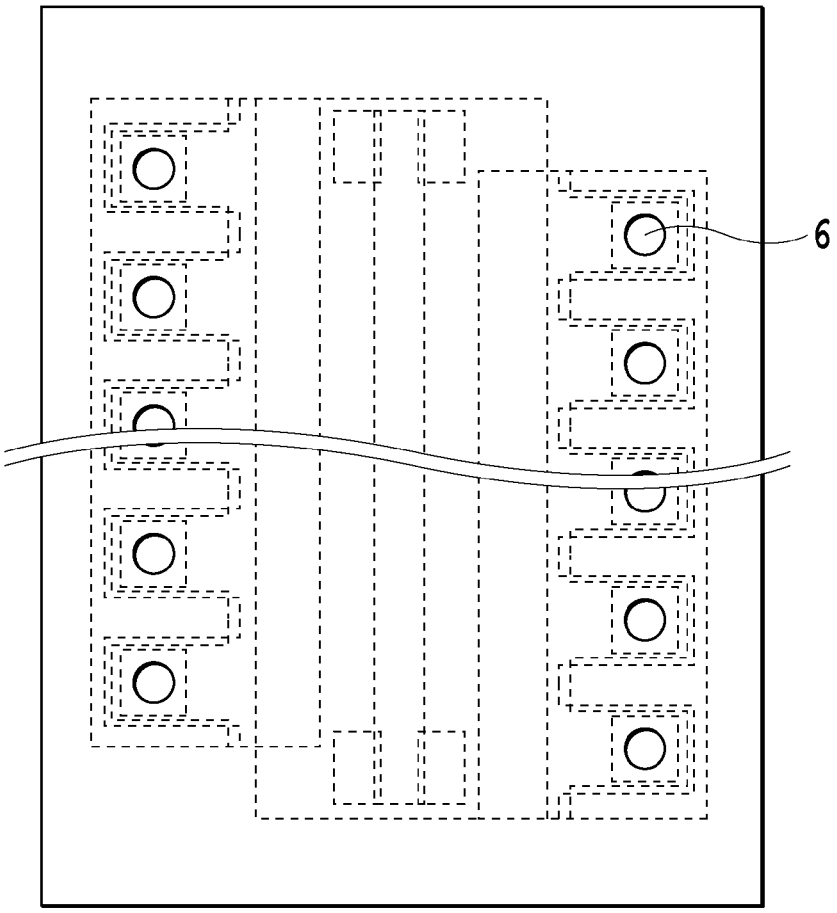
FIGS. 16A and 16B are outline diagrams for explaining the nozzle-forming process of the second embodiment.
Figure 16B:
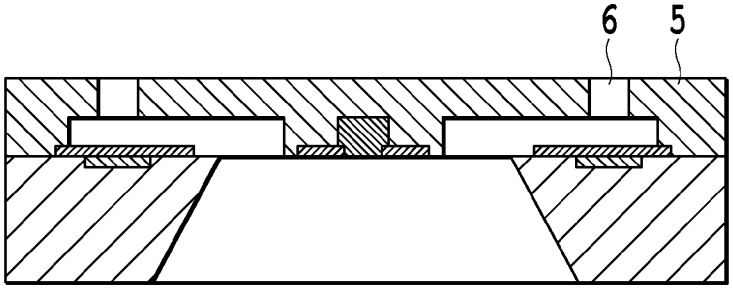

Subsequently, as illustrated in FIGS. 16A and 16B, the mold material is removed. By removing the mold material, the channel and a projection portion having a slit in the eject output plate are formed.

As illustrated in FIGS. 13A and 13B, in the pattern for forming a slit, the inner layer is arranged on the foundation of a part of a pattern end portion. By arranging the inner layer, an adhesion force between the mold material and the inner layer is ensured, and during development by the spin coater, the occurrence of pattern shifting caused by an external force on the pattern end portion can be suppressed.

As described above, also in the present embodiment, by providing the inner layer on the foundation of a part of the pattern for forming a slit, a desired slit can be formed in the projection portion of the ejection outlet plate. As a result, the residual stress in the ejection outlet plate caused by a heat history or the like of a manufacturing process of the liquid ejection head can be eased, the occurrence of nozzle peeling can be suppressed, and a reliable liquid ejection head can be provided.

Other Embodiments

FIGS. 17A and 17B to FIGS. 20A and 20B are outline diagrams illustrating liquid ejection heads of other embodiments. Each FIG. A is a plan view illustrating the substrate of the present embodiment, while each FIG. B is a cross-sectional view illustrating the substrate of the present embodiment.

Figure 17A:
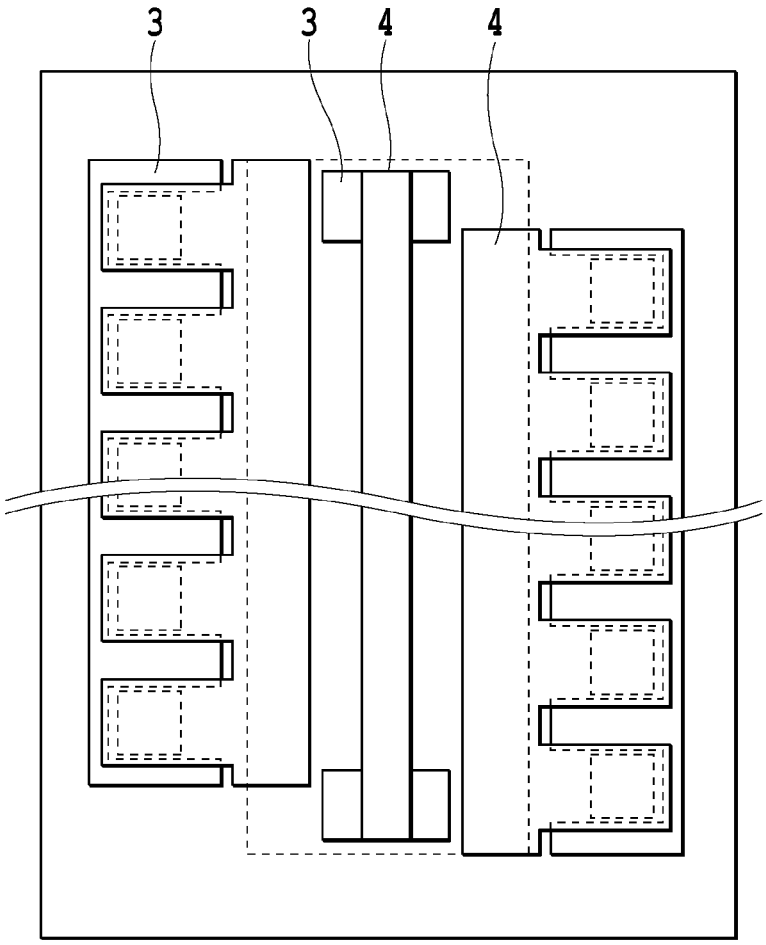
FIGS. 17A and 17B are outline diagrams illustrating a liquid ejection head of another embodiment.
Figure 17B:
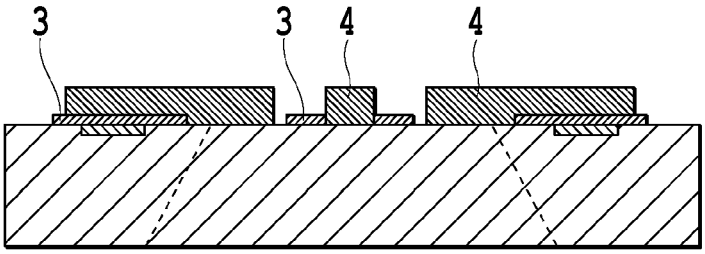

As illustrated in FIGS. 17A and 17B, the printing head of the present embodiment has four rectangular-shaped inner layers provided at positions in contact with end portions of a pattern for forming a slit. In the first embodiment, the inner layer has a circular shape, but by having a rectangular-shaped inner layer, a range in contact with the pattern for forming a slit can be expanded, and an effect of suppressing pattern shifting can be further improved.

Figure 18A:
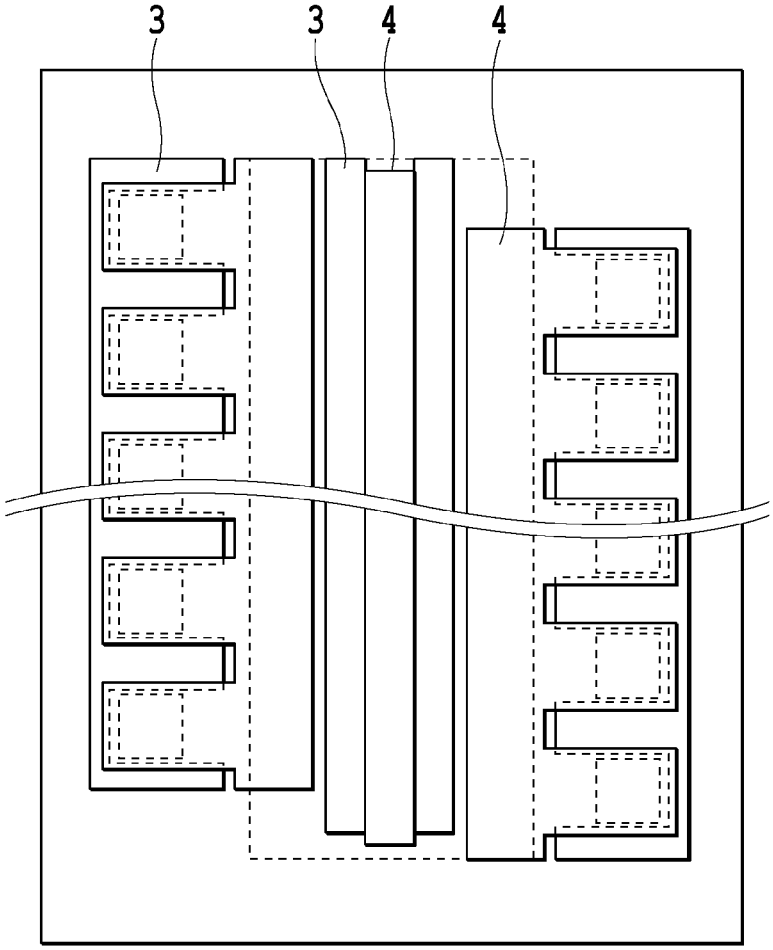
FIGS. 18A and 18B are outline diagrams illustrating a liquid ejection head of another embodiment.
Figure 18B:
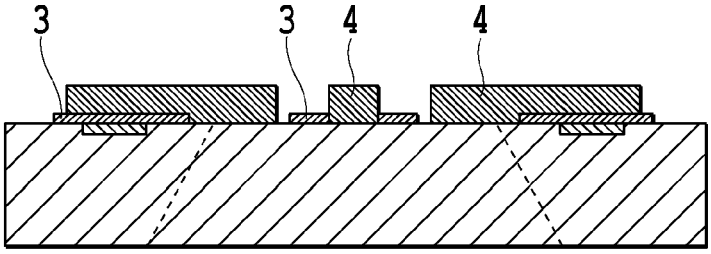

As illustrated in FIGS. 18A and 18B, two band-shaped inner layers may be provided so as to sandwich a pattern for forming a slit. By having a band-shaped inner layer, a range in contact with the pattern for forming a slit can be expanded, and the effect of suppressing pattern shifting can be further improved.

Figure 19A:
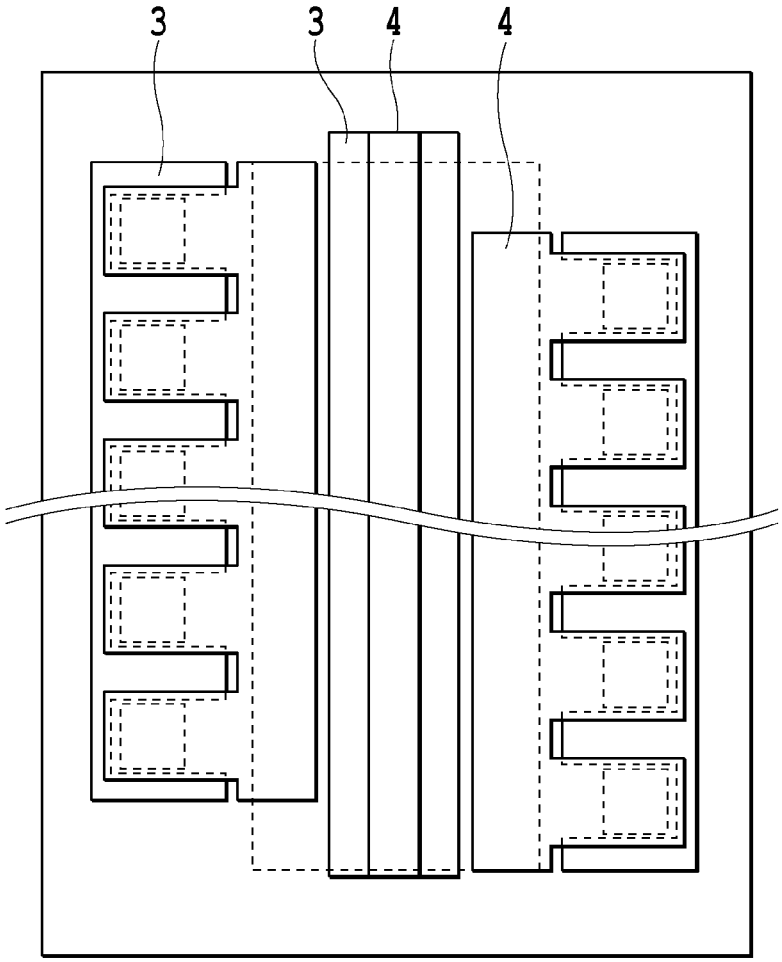
FIGS. 19A and 19B are outline diagrams illustrating a liquid ejection head of another embodiment.
Figure 19B:
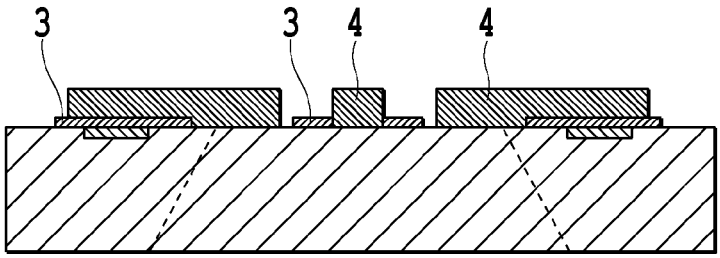

As illustrated in FIGS. 19A and 19B, a pattern for forming a slit is arranged at a position so as to stride an end portion of the opening surface of the supply port, and two band-shaped inner layers may be provided so as to sandwich the pattern for forming a slit. Also in the case where the pattern for forming a slit is arranged at a position so as to stride the end portion of the opening surface of the supply port, the effect of suppressing pattern shifting can be obtained.

Figure 20A:
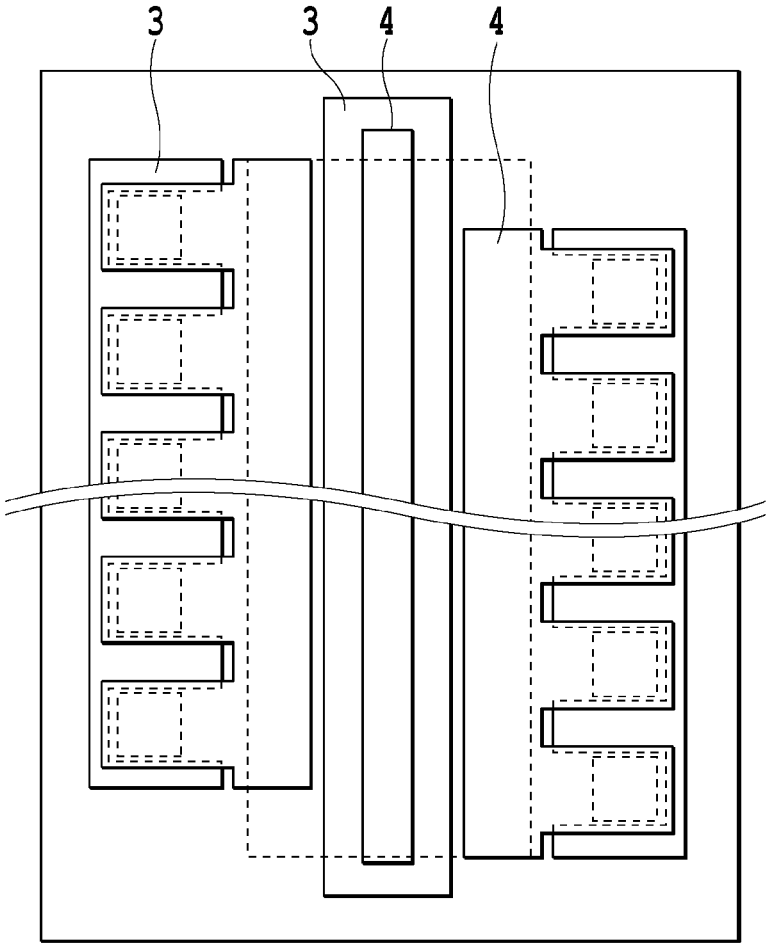
FIGS. 20A and 20B are outline diagrams illustrating a liquid ejection head of another embodiment.
Figure 20B:
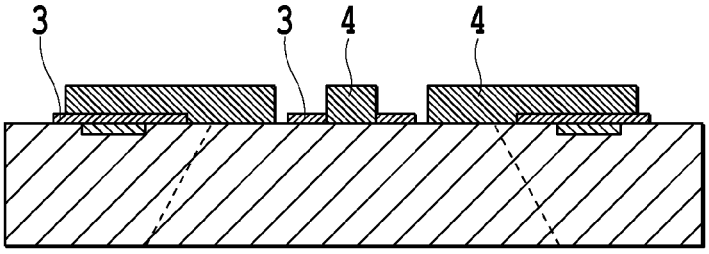

As illustrated in FIGS. 20A and 20B, an inner layer may be provided so as to surround the periphery of the pattern for forming a slit. By having the inner layer so as to surround the periphery, the effect of suppressing pattern shifting can be further improved.

FIGS. 21A and 21B to FIGS. 24A and 24B are outline diagrams illustrating liquid ejection heads of other embodiments. Each FIG. A is a plan view illustrating the substrate of the present embodiment, while each FIG. B is a cross-sectional view illustrating the substrate of the present embodiment.

Figure 21A:
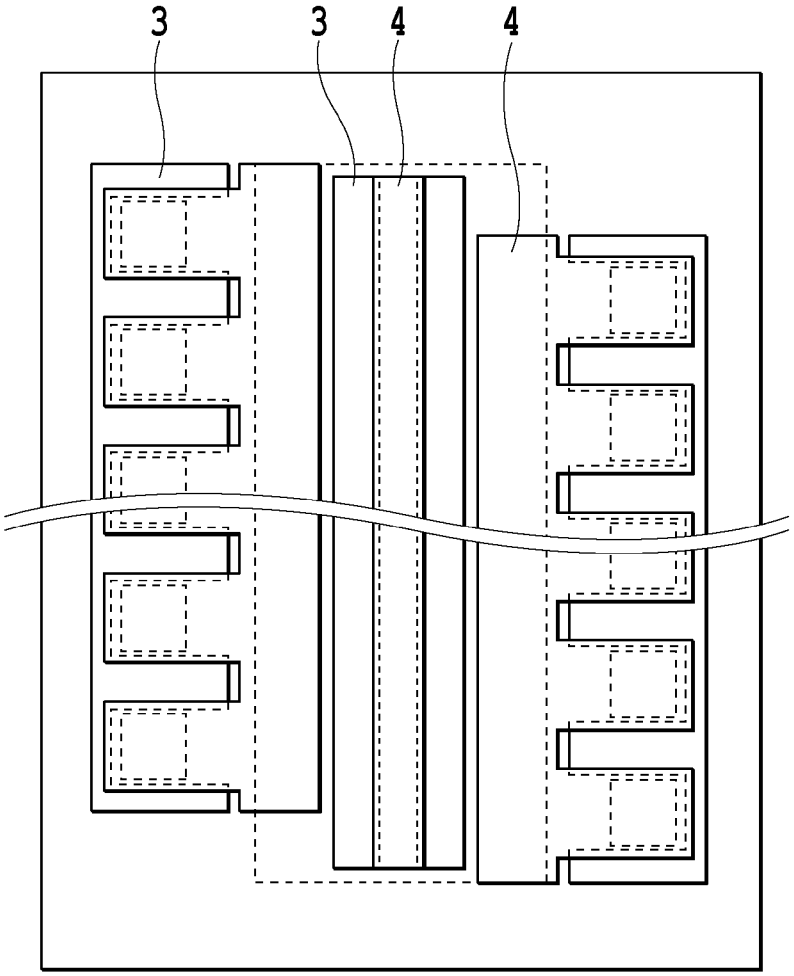
FIGS. 21A and 21B are outline diagrams illustrating a liquid ejection head of another embodiment.
Figure 21B:
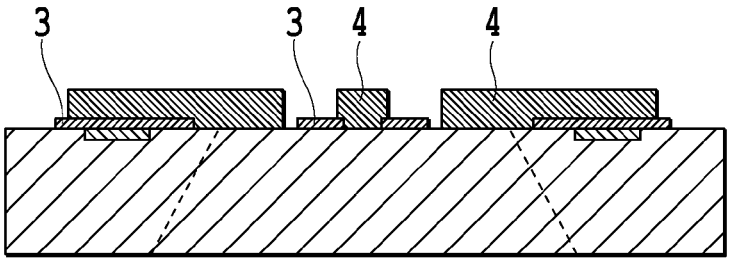

As illustrated in FIGS. 21A and 21B, in a pattern for forming a slit, a band-shaped inner layer may be arranged on a foundation so as to sandwich the pattern. By providing the band-shaped inner layer on the foundation, an adhesion range between the pattern for forming a slit and the inner layer can be expanded, and the effect of suppressing pattern shifting can be further improved.

Figure 22A:
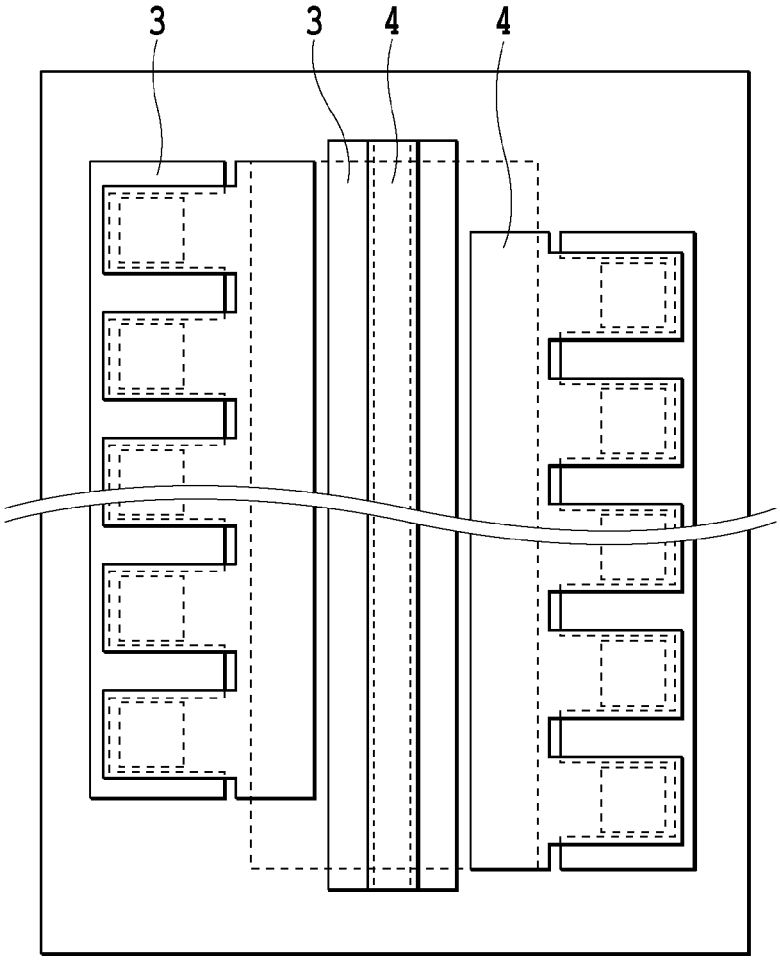
FIGS. 22A and 22B are outline diagrams illustrating a liquid ejection head of another embodiment.
Figure 22B:
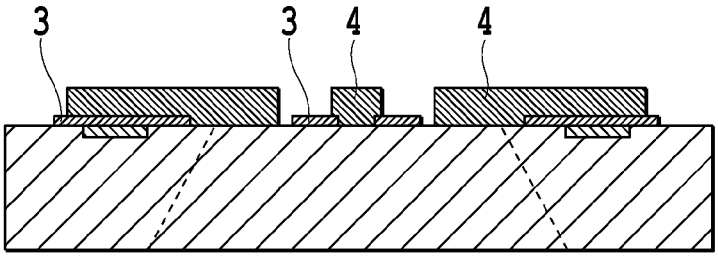

As illustrated in FIGS. 22A and 22B, a pattern for forming a slit may be arranged at a position so as to stride an end portion of the opening surface of the supply port, and a band-shaped inner layer may be arranged on a foundation so as to sandwich the pattern for forming a slit. Also in the case where the pattern for forming a slit is arranged at a position so as to stride the end portion of the opening surface of the supply port, the effect of suppressing pattern shifting can be obtained.

Figure 23A:
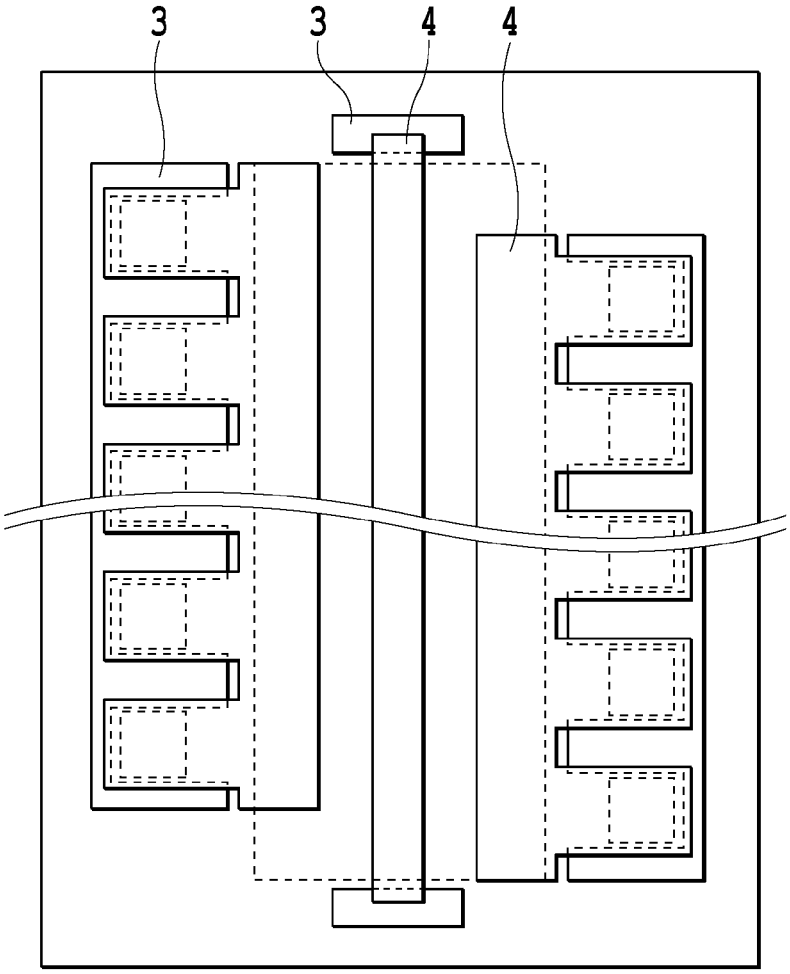
FIGS. 23A and 23B are outline diagrams illustrating a liquid ejection head of another embodiment.
Figure 23B:
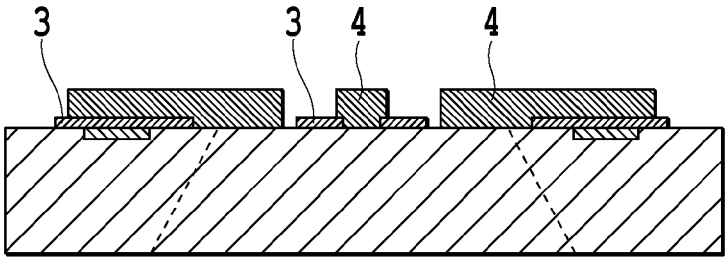

As illustrated in FIGS. 23A and 23B, in a pattern for forming a slit, a rectangular-shaped inner layer may be arranged on a foundation at both end portions of the pattern. In the case where the mold material is to be developed by a spin coater, by arranging, on a foundation, the inner layer on the pattern end portions where the largest external force (centrifugal force) is applied to the mold material, pattern shifting can be suppressed.

Figure 24A:
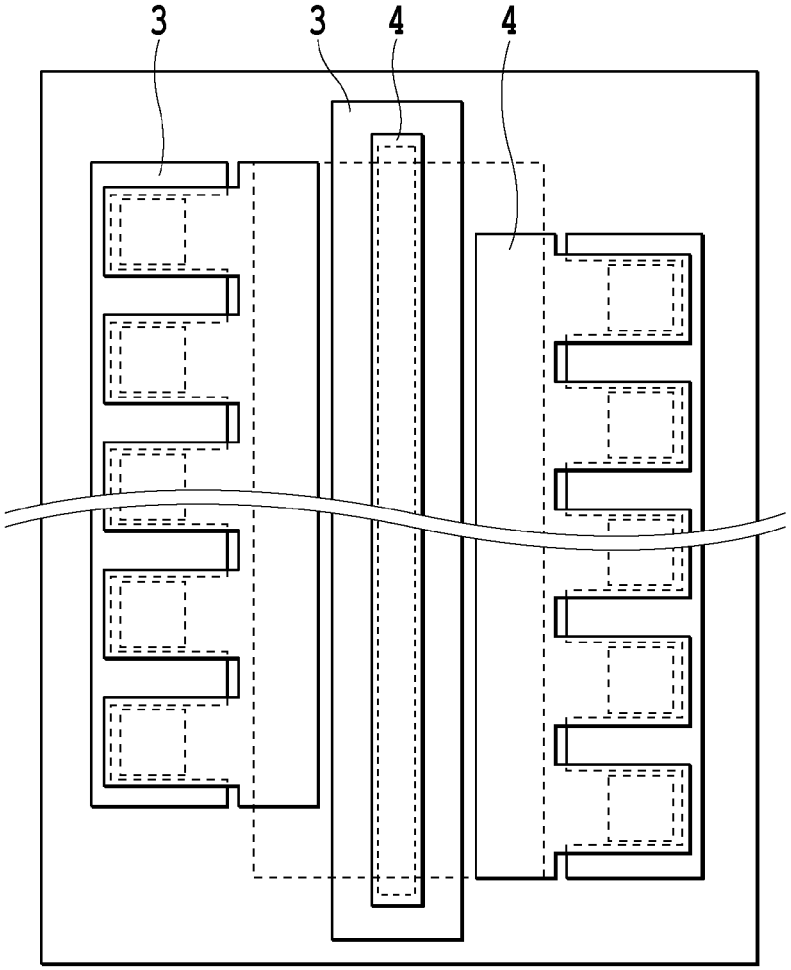
FIGS. 24A and 24B are outline diagrams illustrating a liquid ejection head of another embodiment.
Figure 24B:
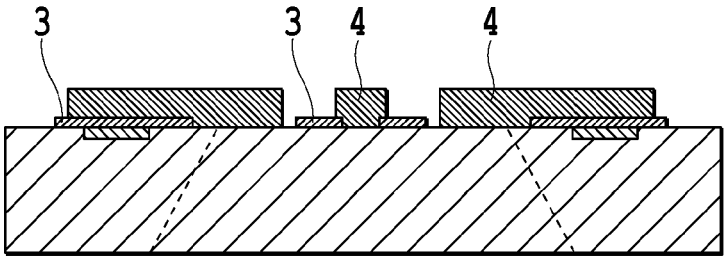

As illustrated in FIGS. 24A and 24B, an inner layer may be provided on a foundation so as to surround the periphery of a pattern for forming a slit. By having the inner layer as the foundation so as to surround the periphery, the effect of suppressing pattern shifting is further improved.

In any of the liquid ejection heads illustrated in FIGS. 21A and 21B to FIGS. 24A to 24B, the inner layer is provided as the foundation on a part of the pattern for forming a slit. Since the inner layer remains even after the mold material is developed, it is necessary to arrange the inner layer at a position where air bubble removing property or the like is considered as a mode of the liquid ejection head. Furthermore, the inner layer needs to be arranged so that a developing solution spreads over the pattern for forming a slit in the case where the mold material is developed.

FIGS. 25A and 25B and FIGS. 26A and 26B are outline diagrams of a liquid ejection head of other embodiments.

Figure 25A:
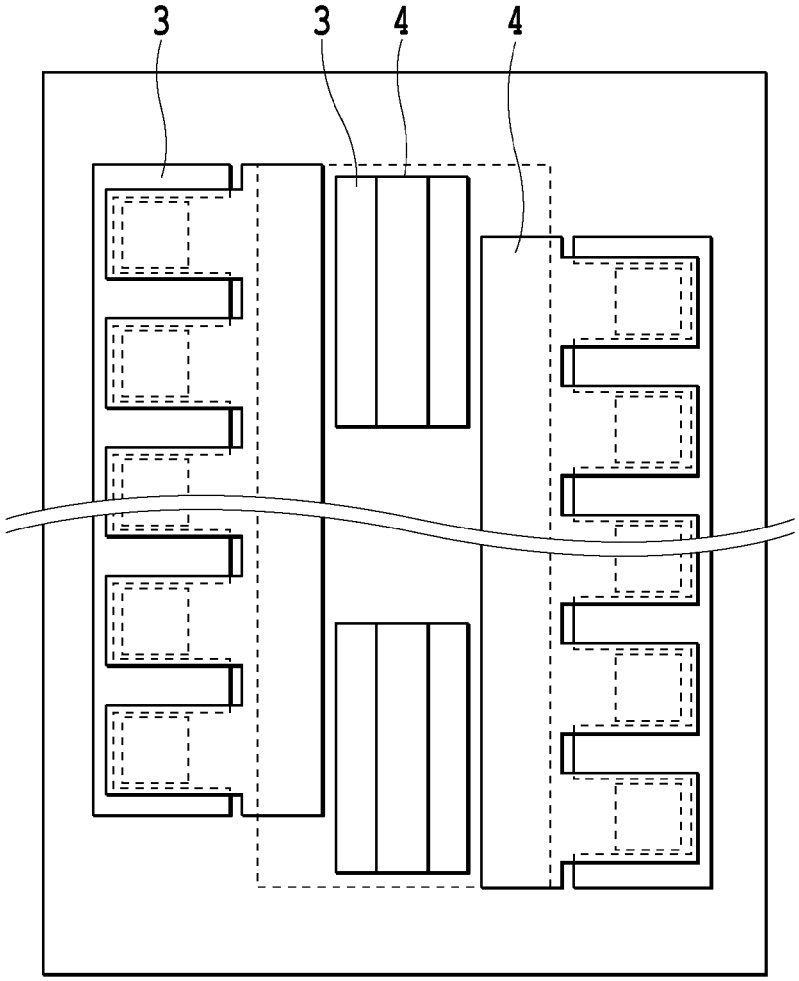
FIGS. 25A and 25B are outline diagrams illustrating a liquid ejection head of another embodiment.
Figure 25B:
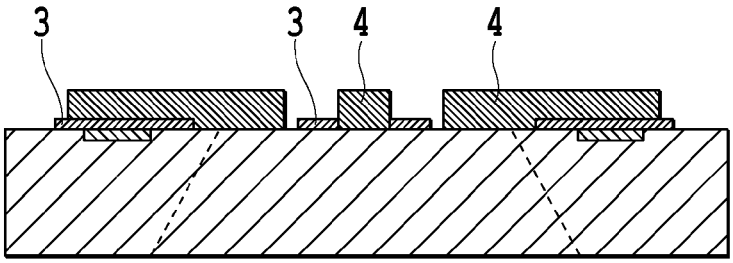

As illustrated in FIGS. 25A and 25B, there is a plurality of patterns for forming a slit. Also with the configuration having a plurality of patterns for forming a slit, by providing an inner layer at a position in contact with the pattern for forming a slit, the effect of suppressing pattern shifting can be obtained.

Figure 26A:
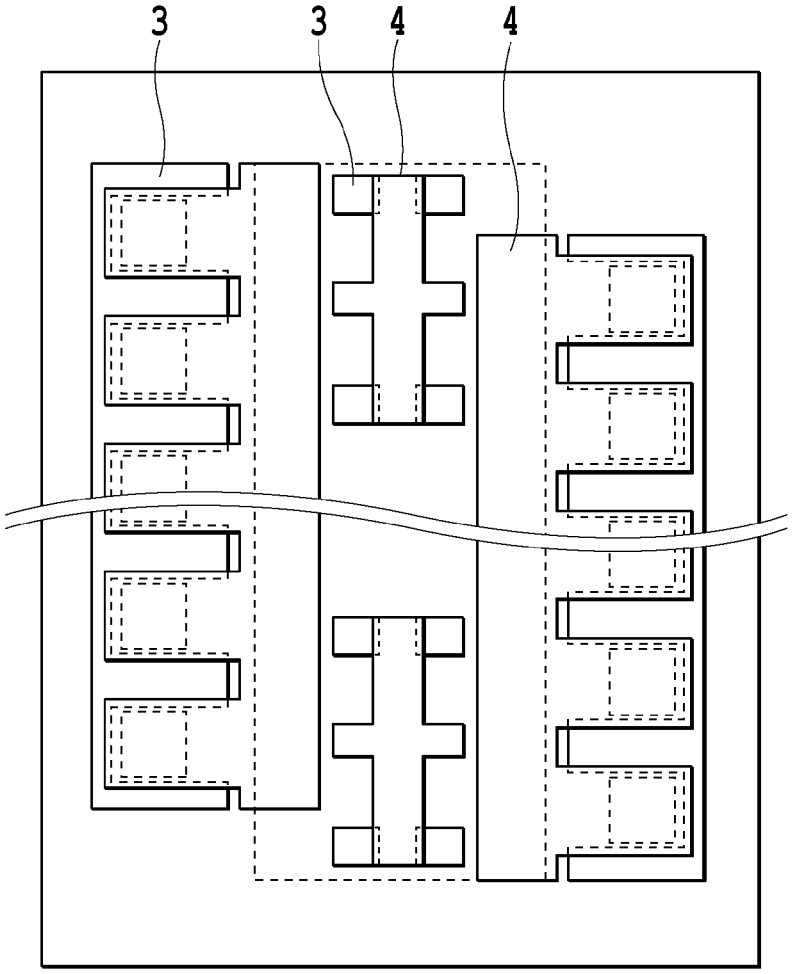
FIGS. 26A and 26B are outline diagrams illustrating a liquid ejection head of another embodiment.
Figure 26B:
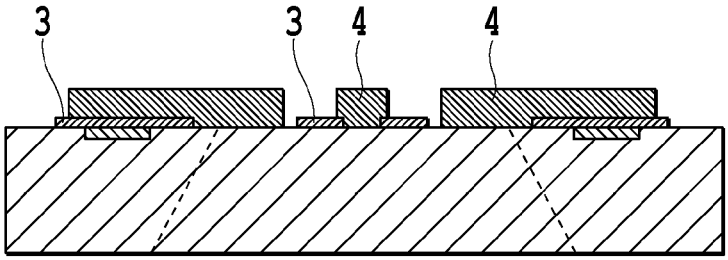

As illustrated in FIGS. 26A and 26B, there is a plurality of patterns for forming a slit, each having a cross shape. Also with the configuration having a plurality of cross-shaped patterns for forming slit, by providing, as the foundation, the inner layer on a part of the pattern for forming a slit, the effect of suppressing pattern shifting can be obtained.

Meanwhile, in the printing head illustrated in FIGS. 25A and 25B and FIGS. 26A and 26B, the patterns for forming a slit having a rectangular shape and having a cross shape are illustrated, but these modes are not limiting.

As described above, also in the other embodiments, pattern shifting in the pattern for forming a slit can be suppressed, and a desired slit can be formed in the projection portion of the ejection outlet plate. As a result, residual stress in the ejection outlet plate caused by a heat history or the like of a manufacturing process of the liquid ejection head can be eased, occurrence of nozzle peeling can be suppressed, and a reliable liquid ejection head can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-127921, filed Jun. 5, 2012, which is hereby incorporated by reference herein in its entirety.

What is claimed is:

1. A manufacturing method of a liquid ejection head including a substrate on which a plurality of elements each generating energy for ejecting liquid is aligned and which has a supply port extending in an alignment direction of the plurality of elements; an ejection outlet plate provided with a plurality of ink ejection outlets each ejecting liquid; a channel communicating with the plurality of ejection outlets and the supply ports formed between the substrate; and the ejection outlet plate by joining of the ejection outlet plate onto the substrate; and a projection portion having a slit at a position facing the supply port of the ejection outlet plate, the method comprising the steps of:

forming a first member on the substrate;

forming a mold material for forming the slit between first member on the substrate;

forming a second member serving as the ejection outlet plate on the mold material; and forming the projection portion by removing the mold material.

2. The manufacturing method of a liquid ejection head according to claim 1, wherein the mold material for forming a slit is provided at a position in contact with the first member.

3. The manufacturing method of a liquid ejection head according to claim 1, wherein the first member is provided on a part of the mold material for forming a slit.

4. The manufacturing method of a liquid ejecting head according to claim 1, wherein the mold material is provided in the alignment direction of the plurality of elements, and the first member is provided at a position corresponding to an end portion of the mold material.

5. The manufacturing method of a liquid ejecting head according to claim 1, wherein regarding a direction intersecting with the alignment direction, the first member is provided on both sides of the mold material.

6. The manufacturing method of a liquid ejecting head according to claim 1, wherein the first member is provided around the mold material.

* * * * *